United States Patent [19]

Peterson

[11] Patent Number: 5,018,468

[45] Date of Patent: May 28, 1991

[54] MULTIPLE POSITION FOOTSTRAP TRACK FOR SAILBOARDS

[76] Inventor: Steven R. Peterson, 7269 Vassar Ave., La Mesa, Calif. 92041

[21] Appl. No.: 344,747

[22] Filed: Apr. 28, 1989

[51] Int. Cl.[5] ..... A63C 15/06

[52] U.S. Cl. ..... 114/39.2; 441/75

[58] Field of Search ..... 441/70, 74, 75, 79; 114/39.2

[56] References Cited

U.S. PATENT DOCUMENTS

| | | | |
|---|---|---|---|
| 3,593,356 | 7/1971 | Schmallfeldt . | |
| 4,421,492 | 12/1983 | Leva | 441/79 |
| 4,718,873 | 1/1988 | Shaw et al. | 441/70 |

FOREIGN PATENT DOCUMENTS

| | | | |
|---|---|---|---|
| 0083106 | 7/1983 | European Pat. Off. | 114/39.2 |
| 3230464 | 3/1984 | Fed. Rep. of Germany | 441/75 |
| 1824449 | 12/1981 | France . | |

*Primary Examiner*—Sherman Basinger
*Assistant Examiner*—Stephen P. Avila
*Attorney, Agent, or Firm*—Vidas & Arrett

[57] ABSTRACT

A sailboard footstrap track which provides an adjustable position, securely held footstrap in a sailboard. The footstrap in the track is movable only on the application of downward pressure on the slide member of the device. Normally, the slide member is raised in a locked position to prevent undesired movement of the footstrap.

9 Claims, 2 Drawing Sheets

MULTIPLE POSITION FOOTSTRAP TRACK FOR SAILBOARDS

BACKGROUND OF THE INVENTION

1. Field of the Invention

This invention relates to sailboards and more particularly to adjustable position footstraps for such watercraft.

2. Description of the Related Art

Sailboards, as a watercraft with features similar to surfboards and sail boats, are controlled by position of the sail and by pressure applied to the board by the feet. In relatively calm, flat water conditions, a sailor may rely on board to foot friction to keep his feet where desired. As the wind and waves increase, it becomes easier for a sailor to lose control due to undesired movement of his feet.

In order to provide greater control during gusty conditions, many sailboards are equipped with a number of footstraps into which a foot may be positioned. As the sailor exerts pressure to the rail of the board through the ball of a foot, the foot is held in place by the footstrap above the arch of the foot. In fact, pressure on the footstrap may be utilized to translate the desired pressure to the board's rails.

Sailboards are manufactured from sophisticated foam blanks which are surrounded with water-tight, strong layers of plastic or fiberglass. Due to this construction, inserts for attachments such as footstraps must be positioned by the manufacturer in the board during construction. Some footstrap inserts may be placed on the longitudinal axis of the board while others may be off-center.

Reviewers of sailboards rate the placement of footstraps on the boards. Sailors of different abilities, weights and sexes are used as reviewers so the reader can decide whose review, as to footstrap design, best fits his or her needs. Unfortunately, no existing board can satisfy an individual's needs under varying conditions.

In European patent application Publication No. 0083106 of Pierre Curtet, a footstrap track is positioned along the board centerline such that the footstrap is movable toward the tip or tail of the board. Curtet provides a groove in which a slide is positioned. Enough friction is provided to prevent the slide from moving along the length of the groove until the sailor exerts sufficient force longitudinally through the attached footstrap. Alternatively, notches may be provided which helps to keep the footstrap and slide from moving too freely.

Unfortunately, the Curtet design does not provide sufficient security since the footstrap may move longitudinally at undesired moments. The so-called "roughness" or "notches" will tend to become looser with repeated use which could cause the sailor to do the "splits".

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. § 1.56(a) exists.

SUMMARY OF THE INVENTION

The invention provides a slidable footstrap track for sailboards in which the footstrap and slide are positively locked in position until the slide is depressed. Once depressed, the slide is free to move longitudinally in the track. As pressure on the slide is discontinued, it is again positively locked into the desired position.

Downward pressure applied through the foot of the sailor is used to release the locking engagement of the slide to the track. Once released, the slide may move in the track with very little effort—leading to a smooth transition. A simple lifting of the foot relocks the footstrap.

BRIEF DESCRIPTION OF THE DRAWINGS

A detailed description of the invention is hereafter described with specific reference being made to the drawings in which.

DESCRIPTION OF THE PREFERRED EMBODIMENTS

Figure 9:
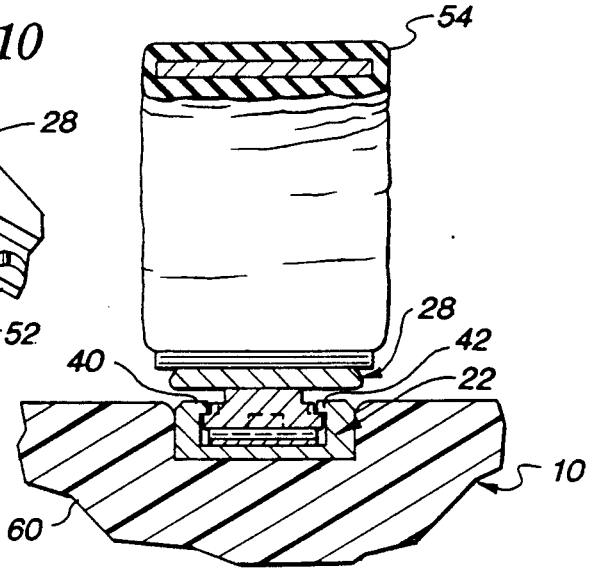
FIG. 9 is a Figure similar to that of FIG. 2 showing a second mounting means.

With reference to the Figures, it will be seen that a sailboard 10 may be equipped with a multiple position footstrap track device 20 of the invention. FIGS. 1–4 show the aftermarket addition of a track device 20 to an existing sailboard. FIG. 9 shows that the track device 20 may be built into the sailboard 10 during fabrication.

Figure 1:
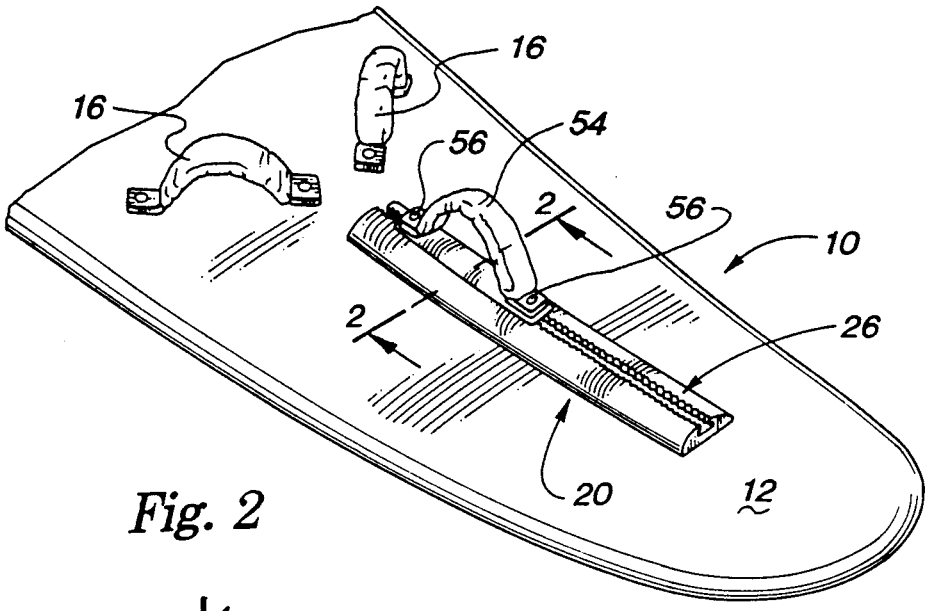
FIG. 1 is a fragmentary perspective view showing the after end of a typical sailboard having the invention installed therein.
Figure 2:
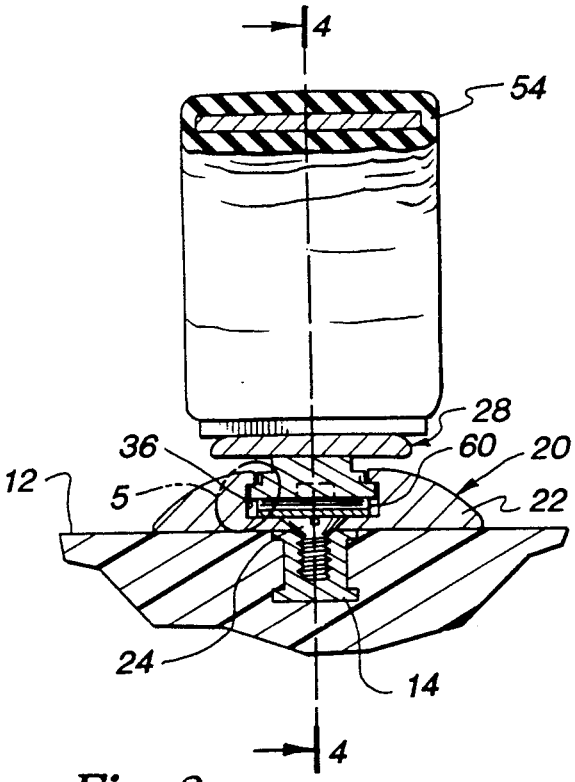
FIG. 2 is a fragmentary section taken along line 2—2 in FIG. 1 and enlarged slightly therefrom.
Figure 3:
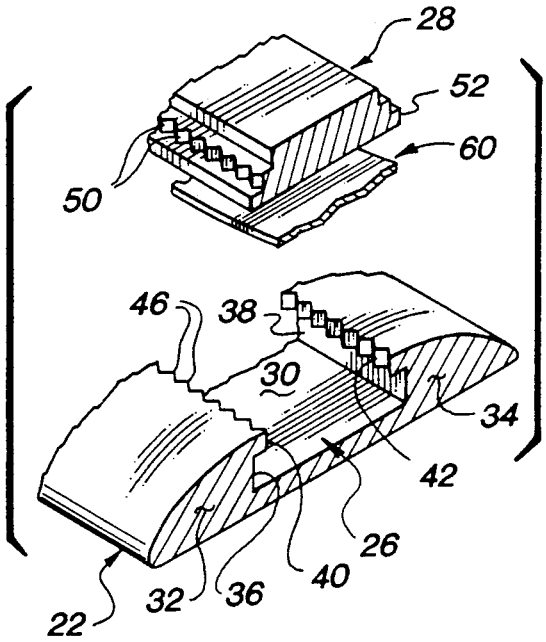
FIG. 3 is an exploded fragmentary section of the track device without the strap.

Track device 20 as shown in FIGS. 1–4 includes a base 22 which is held tightly to deck 12 of sailboard 10 by means of a pair of spaced screws 24 which are threaded into existing encapsulated blind nuts 14 in the sailboard. Nuts 14 are provided for use with standard footstraps 16 such as shown in FIG. 1. The elongated base 22 defines the track 26 in which a slide member or shuttle 28 may move longitudinally. Track 26 is defined by a lower bed 30, and a pair of upstanding rails 32, 34 which defines ways 36,38 and overhanging lips 40, 42 which function to keep shuttle 28 within the track 26. As shown in FIG. 3, lips 40, 42 include a plurality of notches 46 which may cooperate with keys 50 of shuttle 28. Shuttle 28 includes a sole plate 52 which is slightly more narrow than the track defined between ways 36, 38. Keys 50 are located above the sole plate as shown in such a way that they may engage with notches 46 when shuttle 28 is raised upwardly. The thickness of sole plate 52 and keys 50 is such that no engagement of keys and notches is possible when sole plate 52 rests on bed 30.

The construction of shuttle or slide member 28 is such that it may freely move longitudinally in track 26 when sole plate 52 is close to bed 30. Slide member 28 further includes a footstrap 54 which is attached to member 28 by rivets 56 or the like. It will be seen that upward pressure by a foot positioned in strap 54 will raise the shuttle 28 such that keys 50 may engage with notches 46. When so engaged, longitudinal movement of the footstrap is prevented. In order to provide a positive, normal locking between notches 46 and keys 50, a spring means 60 is provided to urge shuttle upwardly. As shown, spring means 60 is depicted as a leaf spring 62 held in position by tabs 64, 66 to recesses 68, 70. Spring 62 normally urges shuttle 28 upwardly into a locking engagement. Downward pressure on the shuttle 28 from a foot overcomes the spring releasing the engagement of notches and keys. So long as downward pressure is exerted, the footstrap may be freely moved along the length of the track. A sudden gust which would tend to lift the sailor will lift the foot in the footstrap 54, which results in immediate locking of the shuttle 28 due to spring means 60. The spring keeps the footstrap from sliding in the track when changing tack. In those circumstances no foot is positioned in the footstrap.

The spring means 60 is shown in the form of a leaf spring. However, any other mechanism which normally urges the shuttle 28 away from bed 30 will function well so long as foot pressure can overcome the normal lifting. Roller balls with springs could be used which could compress downwardly in response to foot pressure to enable movement of the footstrap.

Figure 5:
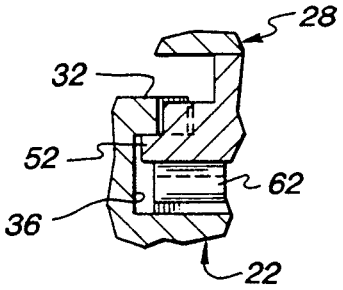
FIG. 5 is an enlarged detail taken from the area encircled at 5 in FIG. 2.
Figure 6:
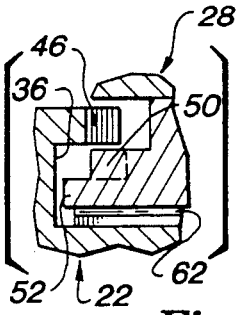
FIG. 6 is a view similar to that of FIG. 5 showing a secondary position.

FIGS. 5 and 6 show the normally locked position and unlocked position of the shuttle 28 in the track 26. In FIG. 5 it will be seen that sole plate 52 can never pass beyond the lips 40, 42, thereby keeping the shuttle 28 captive in the track 26.

Figure 3A:
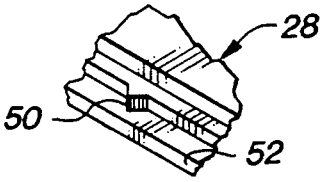
FIG. 3*a* is a fragmentary detail perspective detail view showing a first alternate form of the invention.
Figure 4:
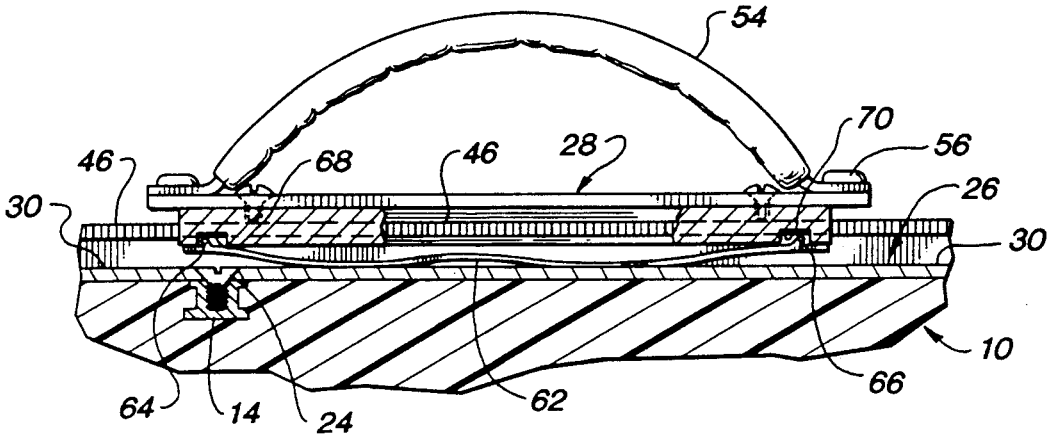
FIG. 4 is a sectional elevation taken along lines 4—4 in the FIG. 2 and slightly reduced therefrom.
Figure 7:
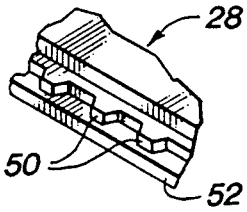
FIG. 7 is a fragmentary detail similar to that of FIG. 3*a* showing a 2nd alternate form of the invention.
Figure 10:
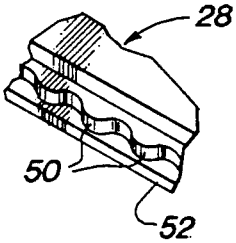
FIG. 10 is a fragmentary detail similar to that of FIG. 3*a*, FIG. 7, and FIG. 8 showing a 4th alternate form of the invention.
Figure 8:
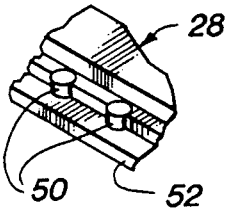
FIG. 8 is a fragmentary detail similar to that of FIG. 3*a* and FIG. 7 showing a 3rd alternate form of the invention.

FIGS. 3*a*, 7, 8 and 10 show varying constructions of the keys 50 of shuttle 28. As shown in FIG. 3*a*, there may be as few as one key per side of the shuttle to engage with notches 46. The keys, as seen in FIG. 7, may be of a different configuration and do not need to present a sawtooth appearance. Finally, FIG. 8 shows an alternate key form in which keys 50 are formed from hardened metal which may be threaded into their positions on the shuttle. This would make assembly simpler and allow replacement of damaged keys.

The base 22 should preferably present a very low profile which will not cause discomfort to a sailor whose foot is positioned in the footstrap. The lowest profile is possible when track device 20 is built directly into the sailboard by the manufacturer, as shown in FIG. 9 In that Figure, the elements of the track device 20 are nearly identical to those shown in the other Figures. However, the outside of the base and rails must be configured to fit into the assembly requirements for inserts into sailboards.

In operation, a sailor standing on the board positions his or her back foot in strap 54. The ball of the foot will rest on the surface of the board and the instep of the foot is in contact with the strap 54. Footsteering is accomplished by changing pressure on the board directly and through the strap. When conditions require placement of the back foot closer to the bow or stern, pressure is exerted downwardly on shuttle 28 disengaging keys 50 from notches 50. The footstrap is then free to move forward or aft to exactly the position needed. As soon as downward pressure is discontinued, the strap 54 is locked into place. This is especially useful during unexpected gusts. During a gust, the sailor needs the footstrap to keep control of the board.

In the design of the French patent, a sailor may be forced to do the splits since the locking engagement is not positive. So long as sufficient longitudinal force is exerted, the French strap may move. In the present invention, the foot raises during a gust which re-establishes the positive locking afforded by the inventive construction.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

This completes the description of the preferred and alternate embodiments of the invention. Those skilled in the art may recognize other equivalents to the specific embodiment described herein which equivalents are intended to be encompassed by the claims attached hereto.

What is claimed is:

1. A hands-free sliding footstrap track for sailboards which is adjustable with foot pressure comprising:

a) a track member;

b) a slide member captively held to said track;

c) a footstrap attached to an upper portion of said slide member; and d) positioning means for releasably securing said slide member from longitudinal movement to said track, said positioning means including a mechanism which urges said slide member upwardly into a locked position, said means allowing movement of said slide member relative to said track only on the application of downward pressure on said slide member to allow a user to preposition the footstrap while sailing by using foot pressure.

2. The footstrap track of claim 1 wherein said positioning means includes spring means positioned between a bed of said track member and said slide member such that said spring means urges said slide member away from said bed of said track member thereby locking said slide member in a fixed position until the force of the spring is overcome by the downward force of a foot.

3. The footstrap track of claim 2 wherein said slide member and said track member are constructed and arranged with at least one mating keyway which interlock to prevent longitudinal movement of said slide member relative to said track member when said slide member is urged upwardly away from the bed of said track.

4. The sliding footstrap track of claim 1 wherein said track member is constructed and arranged to include a plurality of notches and said slide member includes at least one key constructed and arranged such that each of said at least one keys may interlock with notches of said track member when said urging mechanism urges the slide member up into engagement with said track member.

5. The sliding footstrap track of claim 2 wherein said spring means includes a leaf spring positioned between said slide member and the bed of said track member.

6. A hands-free sliding footstrap track for sailboards comprising:

a) means defining a track;

b) sliding means cooperating with said track means to enable said sliding means to move along the length of said track means;

c) means for attaching a footstrap to said sliding means; and d) positioning means for releasably securing said sliding means to said track, said positioning means including a normally closed locking mechanism which urges said sliding means up into a locked position against said track, said positioning means preventing movement of said sliding means relative to said track until downward pressure is applied to said sliding means to allow a user to preposition the footstrap while sailing by using foot pressure.

7. The sliding footstrap track of claim 6 wherein said positioning means includes spring means positioned between a bed of said track and said sliding means such that said slide member is urged away from said bed of said track until sufficient foot pressure is exerted against said slide member to overcome said spring means.

8. The sliding footstrap track of claim 6 wherein said track is constructed and arranged to define a longitudinal groove with parallel, overhanging, notched lips and said sliding means includes a slide member captively held within the groove of said track, said slide member being urged upwardly into a locked position with said notched lips by a spring mechanism until the force of said spring is overcome by the application of downward foot pressure.

9. The sliding footstrap track of claim 8 wherein said slide member includes a pair of opposing, parallel surfaces each of which includes at least one key constructed and arranged to mate with a notch of said track lip notches.

* * * * *